US006461446B1

(12) United States Patent
Satoh et al.

(10) Patent No.: US 6,461,446 B1
(45) Date of Patent: Oct. 8, 2002

(54) WASHING PROCESS AND WASHING UNIT

(75) Inventors: Fumitake Satoh; Kazuyoshi Arai; Kazuhiro Miyamae; Tomoyuki Yanagihara; Tatsuya Naitoh; Tomoki Seo, all of Fujisawa (JP)

(73) Assignee: Mix Co., LTD, Fujisawa (JP)

( * ) Notice: Subject to any disclaimer, the term of this patent is extended or adjusted under 35 U.S.C. 154(b) by 0 days.

(21) Appl. No.: 09/381,289

(22) PCT Filed: Jan. 22, 1999

(86) PCT No.: PCT/JP99/00242

§ 371 (c)(1),
(2), (4) Date: Dec. 6, 1999

(87) PCT Pub. No.: WO99/37414

PCT Pub. Date: Jul. 29, 1999

(30) Foreign Application Priority Data

Jan. 22, 1998 (JP) ..... 10-025085
Oct. 5, 1998 (JP) ..... 10-282767

(51) Int. Cl.[7] ..... B08B 7/04

(52) U.S. Cl. ..... 134/42; 510/435; 510/437; 510/480; 252/175; 252/181; 252/179; 8/137; 8/158; 205/478; 68/13 A

(58) Field of Search ..... 510/435, 437, 510/480; 252/175, 181, 179; 8/137, 158; 205/478; 134/42; 68/13 A

(56) References Cited

U.S. PATENT DOCUMENTS 3,339,737 A * 9/1967 Kiscellos et al. ..... 210/134
3,937,042 A * 2/1976 Loeb ..... 68/13 A
3,985,669 A * 10/1976 Krummel et al. ..... 252/116
4,472,287 A * 9/1984 Ramachandran et al. .... 252/8.7
4,530,774 A * 7/1985 Davies et al. ..... 252/108
4,605,509 A * 8/1986 Corkill et al. ..... 252/131
4,793,942 A * 12/1988 Lokkeomoe et al. ..... 252/99
4,911,856 A * 3/1990 Lokkeomoe et al. ..... 252/95
5,443,751 A * 8/1995 Mozzola ..... 252/174.13

* cited by examiner

*Primary Examiner*—Sharidan Carrillo
(74) *Attorney, Agent, or Firm*—Arent Fox Kintner Plotkin & Kahn, PLLC

(57) ABSTRACT

Washing items are washed simultaneously with softening washing water comprising alkali metal ion and at least one of carbonate ion and bicarbonate ion. The washing water before being softened is obtained by electrolyzing an aqueous solution of sodium hydrogencarbonate having a pH of 9.5 or more and an electric conductivity of 150 mS/m or more. The softened washing water has a total hardness of 40 ppm or less.

2 Claims, 1 Drawing Sheet

WASHING PROCESS AND WASHING UNIT

FIELD OF THE INVENTION

The present invention relates to a new washing process and a washing apparatus suitable to washing clothes, tableware, medical equipments and washing hands, etc.

BACKGROUND OF THE INVENTION

Surfactant, such as chemicals and soup, have been heretofore been used for washing clothes, tableware, medical equipment, toilets, etc., however, there have been problems of causing chapping hands when washing, a safety issue on body by residual detergent on washing items, and residual harmful substances after a treatment of discharging water, etc.

Inventors of the present invention have proposed a so-called non-detergent washing method by using electrolyzed water as disinfectant detergent. It utilizes a protein removing effect of alkaline electrolytic water obtained by electrolyzing water comprising electrolyte and a disinfection effect of acid electrolytic water, which have been widely noticed as substitution of conventional chemicals and surfactant.

When applying such a kind of detergent to purposes of washing clothes and dishes, etc., it is on the assumption to have detergency comparable to or more excellent than the conventional detergent has. It is necessary, when designing detergent, to construct in terms of washing mechanism what kind of property should be a controlling factor.

It is also required to be harmless to human body even if a user takes it by mistake, to be safe not to cause chapped skin when touched by hands and to be easily handled.

Furthermore, it is required that the waste water containing the detergent after washing clothes and dishes, etc. excels in being easily handled able to be discharged as it is to the living environment without any special treatment, that is, excels in easy treatment of discharged water.

DISCLOSURE OF THE INVENTION

An object of the present invention is to provide a washing process and a washing apparatus having detergency comparable to or more excellent than that of a washing process using conventional detergent, being low at cost, excelling in safety, being easily handled, and thereby the waste water is easily treated.

The inventors of the present invention diligently studied washing mechanism and found that it was possible to obtain detergency comparable to detergent of the prior art, such as surfactant, or increased detergency by softening washing water, and with a cleanser effect and adsorptive effect of compositions produced at the time of softening the washing water. They also found that remarkable detergency was attained by softening a solution comprising alkali metal ion and carbonate ion and/or bicarbonate ion.

(1) Namely, a washing process of the present invention washes items to be washed simultaneously with softening washing water comprising alkali metal ion and at least one of carbonate ion and bicarbonate ion.

Also, the washing process of the present invention softens the washing water comprising alkali metal ion and at least one of carbonate ion and bicarbonate ion and washes items to be washed with the softened washing water.

Namely, a timing of softening the washing water comprising the above specified ions may be before washing or during washing. It is preferable to soften the water during washing.

Mainly, calcium ion $Ca^{2+}$ and magnesium ion $Mg^{2+}$ give a negative influence on detergency. In the present invention, since the washing water comprises at least one of carbonate ion $CO_3^{2-}$ and bicarbonate ion $HCO_3^-$, calcium ion $Ca^{2+}$ and magnesium ion $Mg^{2+}$ bond with them and the existing ratio of the calcium ion $Ca^{2+}$ and magnesium ion $Mg^{2+}$ in the washing water becomes small. Therefore, the detergency is not decreased.

In addition to this, calcium carbonate $CaCO_3$ or magnesium carbonate $MgCO_3$ precipitated as a result of bonding calcium ion $Ca^{2+}$ and magnesium ion $Mg^{2+}$ with magnesium carbonate ion $CO_3^{2-}$ physically removes dirt/stain by the cleansing effect and adsorption effect thereof, thus, contributes to increase the detergency.

Namely, the present invention is not simply a washing method using softened water nor to soften washing water, but also to generate compositions capable of physically removing dirt/stain simultaneously with softening the water.

Accordingly, when pouring the washing water comprising alkali metal ion and at least one of carbonate ion and bicarbonate ion together with washing items into the washing bath, calcium ion and magnesium ion contained in the washing water bond with the carbonate ion and bicarbonate ion to precipitate calcium carbonate and calcium bicarbonate. As a result, the washing water in the washing bath is softened and calcium carbonate, etc. having a cleansing effect and adsorption effect is generated at the same time.

(2) The alkali metal ion according to the present invention is obtained by making aqueous solution of alkali metal sodium. As the alkali metal ion, potassium salt, sodium salt, lithium salt, etc. are mentioned in terms of improving detergency. Especially, potassium salt and sodium salt are preferable for being inexpensive and easy to obtain and excelling in safety and treatment of waste water.

The carbonate ion according to the present invention is obtained by making an aqueous solution of alkali metal sodium carbonate, and the bicarbonate ion is obtained by making an aqueous solution alkali sodium bicarbonate. As the alkali metal sodium carbonate, for example, sodium carbonate [$Na_2$ $CO_3$], potassium carbonate [$K_2$ $CO_3$], lithium carbonate [$Li_2$ $CO_3$], etc. can be mentioned, and as the alkali metal sodium bicarbonate, for example, potassium hydrogencarbonate [$KHCO_3$], sodium hydrogencarbonate [$NaHCO_3$], etc. can be mentioned.

The solvent for dissolving the above alkali metal ion and at least one of carbonate ion and bicarbonate ion is not specifically limited, and a variety of waters, for example, tap water, well water, soft water, refined water, pure water, or mixed water of these, etc. can be used.

(3) In the present invention, the washing water before being softened has a pH of 8.5 to 12.0, preferably 9.5 to 11.0, more preferably 10.0 to 11.0. By setting the pH 8.5 or more (preferably 9.5 or more, more preferably 10.0 or more), it becomes preferable in terms of promoting to bond calcium ion and magnesium ion with carbonate ion and bicarbonate ion. By setting the pH 12.0 or less (preferably, 11.0 or less), it becomes preferable in terms of safety against chapped hands, etc. and treatment of waste water.

Furthermore, in the present invention, the concentration of alkali metal ion, that of carbonate ion, and/or that of bicarbonate ion in the washing water before being softened are preferably within predetermined ranges, and such concentrations of ions can be indirectly specified by an electric conductivity (EC). Namely, the electric conductivity EC of the washing water before being softened is preferably 50 mS/m or more, more preferably 100 mS/m or more, and most preferably 150 mS/m or more. By setting the electric conductivity at such a high range, sufficient concentration of ions can be secured for invalidating $Ca^{2+}$ and $^{2+}$ in the aqueous solution by bonding them with $CO_3^{2-}$ and $HCO_3^-$.

The washing water before being softened can be obtained by electrolyzing, for example, a sodium hydrogencarbonate solution. At this time, when using a water flowing type electrolyzing apparatus having a high generation performance, cathode electrolytic solution generated in a cathode chamber is preferably set to have a concentration able to be used as washing water as it is in terms of handling. While, when using a batch type electrolyzing apparatus having a low generation performance, it is preferable to generate electrolytic solution of a high concentration and to dilute the same for using in terms of reducing the generation costs. The solvent for diluting at this time is not specifically limited and easily obtainable tap water, etc. can be used.

(4) In the washing process of the present invention, the process of softening the washing water comprising alkali metal ion and at least one of carbonate ion and bicarbonate ion preferably includes a process of promoting to soften the washing water.

As such a process of promoting to soften water, a process of applying heat energy to the washing water to be softened, a process of physically stirring or airing the washing water to be softened, a process of securing time for water softening reaction by leaving the washing water to be softened still, etc. can be mentioned as examples.

By applying heat energy to the washing water, for example, by heating the washing water or generating the washing water under a high temperature state, an activity level of ions becomes high, the reaction of calcium ion and magnesium ion with carbonate ion and bicarbonate ion is promoted, and water softening is completed in a short period of time.

Also, when performing stirring or airing, a collision frequency between ions mechanically increases, so the reaction between magnesium ion and carbonate ion and/or bicarbonate ion is promoted and water softening is also completed in a short period of time by this.

Also, other than these forcible processes, a sufficient reaction time can be secured by leaving the washing water still and thereby water softening can be promoted, as well.

(5) The total hardness of the softened washing water is 35 ppm or less, preferably 15 ppm or less, more preferably 10 ppm or less. By setting the total hardness within this range, further increase of detergency can be expected.

(6) In the present invention, in order to reduce the total hardness in a short time to further increase the detergency, it is preferable to add coagulation agent or chelating agent to the above softened washing water having a reduced total hardness.

It is because, by adding the coagulation agent or chelating agent at this timing, the reduction of the total hardness can be attained in a short time. As the coagulation agent, for example, aluminum sodium sulfate (sodium alum), etc. can be mentioned, and as the chelating agent, EDTA, zeolite, etc. are mentioned as examples.

Also, in order to reduce the total hardness in a short time for further increased detergency, it is preferable to add fatty acid to the above softened washing water having a reduced total hardness. It is because, by adding fatty acid at this timing, reduction of the total hardness can be attained in a short time. As the fatty acid, oleic acid, etc. can be mentioned as an example. The same effect can be also obtained by adding soap.

A timing of adding the coagulation agent, chelating agent or fatty acid is not specifically limited, however, preferably, it is added when the total hardness of the washing water becomes 35 ppm or lees (preferably 15 ppm or less, more preferably 10 ppm or less).

(7) According to another viewpoint of the present invention, there is provided a washing apparatus including a means to wash items to be washed simultaneously with softening the washing water comprising alkali metal ion and at least one of carbonate ion and bicarbonate ion.

There is also provided a washing apparatus including a means to wash the washing items with the softened washing water after softening the washing water comprising alkali metal ion and at least one of carbonate ion and bicarbonate ion.

In this case, it is preferable to further include a means to promote to soften the above washing water.

It is also preferable to include a means to generate the above washing water before being softened by electrolyzing aqueous solution of sodium hydrogencarbonate.

It is also preferable to include a means to add coagulation agent or chelating agent after the total hardness of the above washing water to be softened becomes 35 ppm or less.

It is also preferable to include a means to add fatty acid after the total hardness of the above washing water to be softened becomes 35 ppm or less.

The above washing apparatus can be applied to a domestic or business purpose washer, dish washer, medical equipment washing apparatus, grease removing washer for processing machine, etc.

BEST MODE FOR CARRYING OUT THE INVENTION

Figure 1:
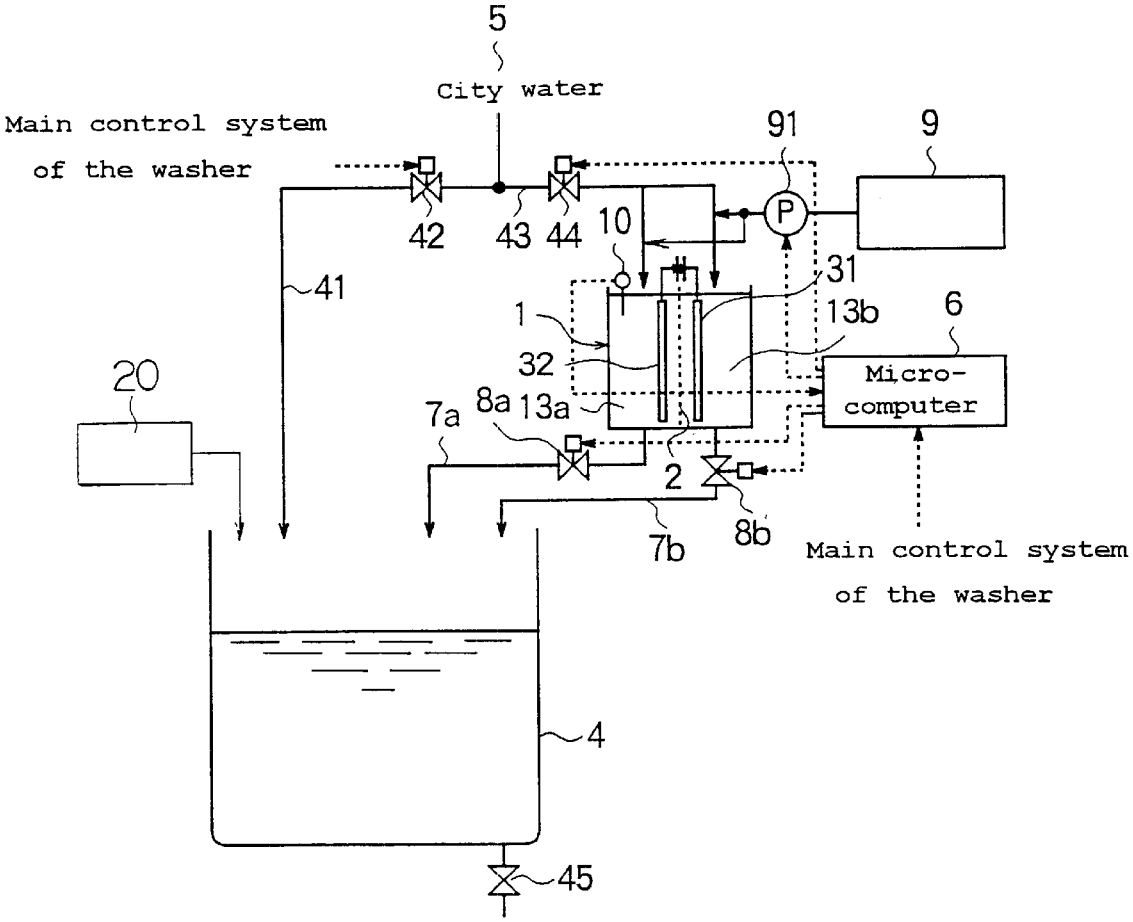
FIG. 1 is a schematic structural view of an embodiment of a washing apparatus of the present invention.

The reference number 4 in FIG. 1 indicates a washing bath and the reference number 5 indicates a faucet of water supply. Tap water is supplied from the faucet 5 to the washing bath 4 via a pipe 41, and the tap water is supplied and stopped by operating a solenoid valve 42 provided to the pipe 41. The operation of the solenoid valve 42 is carried out by an instruction signal from a main control system (main micro-computer) outside the FIGURE.

A batch type electrolyzing cell 1 is built in in this washer and a pair of electrode plates 31 and 32 are provided putting a diaphragm (for example, a cation exchange film) between them. Then, an anode electrode is applied to the electrode plate 31 and a cathode electrode is applied to the electrode plate 32, respectively from a micro computer (sub-control system) 6 via a switch outside the FIGURE. The electrolytic solution generated in a cathode chamber 13*a* being provided with the cathode electrode plate 32 is supplied to the washing bath 4 via a pipe 7*a* being provided with a solenoid valve 8*a*. In the same way, the electrolytic solution generated in an anode electrode chamber 13*b* being provided with the anode electrode plate 31 is supplied to the washing bath 4 via a pipe 7*b* being provided a solenoid valve 8*b*. The control of opening/closing of the solenoid valves 8*a* and 8*b* is carried out by an instruction signal from the micro computer 6.

A pipe 43 branched from the pipe 41 of the above faucet 7 is provided with a solenoid valve 44, and further branched on the downstream side, and supplies the tap water-respectively to the cathode chamber 13*a* and anode chamber 13*b* of the electrolyzing cell 1. Also, an electrolyte adding apparatus 9 for adding electrolyte to the respective pipes to the cathode chamber 13*a* and anode chamber 13*b* is provided, and a predetermined amount of electrolyte, such as sodium hydrogencarbonate, is supplied to the tap water introduced to the cathode chamber 13*a* and anode chamber 13*b* by driving a pump 91.

Note that the control of opening/closing of the solenoid valve 44 provided to the pipe 43 and driving/stopping of the pump 91 of the electrolyte adding apparatus 9 are carried out by an instruction signal from the micro computer 6.

Furthermore, a sensor 10 is provided in the cathode chamber 13*a* for measuring a pH and EC, and an output signal (pH and EC values) from the sensor 10 is sent to the micro computer 6.

In such a washer, the solenoid valve 44 is opened first to supply tap water to the cathode chamber 13*a* and anode chamber 13*b,* and the pump 91 is driven at the same time to add electrolyte to the tap water to the cathode chamber and the anode chamber. Then, a voltage is applied to the both electrode plates 31 and 32 and the electrolyzation continues until the pH value and the EC value of the electrolytic solution in the cathode chamber 13*a* measured by the sensor 10 respectively become predetermined values or more.

When the pH value and the EC value by the above sensor 10 become predetermined values or more, applying of voltages is stopped, an instruction from the micro computer of the washer is waited for opening the solenoid valves 8*a* and 8*b,* and electrolytic solution at the cathode side generated in the cathode chamber 13*a* is supplied to the washing bath 4.

The washing water is automatically added to the washing bath 4 in this way, so washing items are put in and usual washing is carried out. When discharging the waste water after washing, a discharging valve 45 of the washing bath 4 is open. Prior to that, however, the electrolytic solution at the anode side may be supplied to the washing bath 4 by opening the solenoid valve 8*b* to sterilize the laundry and at the same time to neutralize the discharged water. Note that the electrolytic solution generated at the anode side generated in the anode chamber 13*b* may be kept as it is without being supplied to the washing bath 4 or may be discharged as it is.

Also, in addition to this, by preparing a means to measure the total hardness inside the washing bath 4 (or by providing a timer instead of this for measuring a predetermined time to be passed), coagulation agent, chelating agent or fatty acid may be added from the adding apparatus 20 when the total hardness reaches to a predetermined value.

A washing process of the present invention will be explained based on a specific embodiment below.

EXAMPLE 1

A batch type electrolyzing apparatus 1 shown in FIG. 1 was used, after respectively supplying 1 litter of tap water (municipal tap water in Fujisawa city, pH 7.6, EC 17.5 mS/m, calcium hardness 55 ppm, total hardness 75 ppm, water temperature 3.4° C.) to the both electrolyzing chambers 13*a* and 13*b,* 36 g of sodium hydrogencarbonate ($NaHCO_3$) was respectively added to the cathode camber 13*a* and anode chamber 13*b,* a voltage was applied so as to flow a constant current of 15 A to the both electrode plates, and electrolyzation was carried out for 30 minutes. Note that a cation exchange film was used as a diaphragm and the distance between the electrode plates 31 and 32 was set 5 mm. Note that a pH was measured by using a pH meter (trade name of D-13, manufactured by Horiba Ltd.), an EC was measured by using an EC meter (trade name of CM-14P, manufactured by TOA Corporation) and a hardness was measured by using a hardness meter (trade name of WAD-Ca, manufactured by Kyoritu Physical and Chemical Research Institute, measurement accuracy in color comparing mode was 5 ppm).

As a result, electrolytic solution at the cathode side having a pH of 10.55 and an EC of 6000 mS/m or more was obtained. By diluting this by 30 times with tap water, washing water before being softened having a pH of 10.7, an EC of 196.1 mS/m, a calcium hardness of 40 ppm, a total hardness of 60 ppm and a water temperature of 20° C. was obtained.

Mixed stain of china ink and olive oil, blood, cacao butter (animal and vegetable oil), red wine, and mixed stain of blood, milk and china ink were allowed to adhere to cotton fabric samples, respectively (EMPA101, 111, 112, 114, 15 and 116). The stained fabric samples were washed with a domestic washer of double bath type (trade name of ES-25E, 2.5 kg type, manufactured by Sharp Corp.) for 20 minutes, pin-dried and dried by a drier.

The result of a whiteness index and detergency ratio of he fabric samples after washing is shown in Table 1. Note that the "whiteness index" is an average of ten points on two sides of the artificially stained fabric measured by a whiteness index measure (trade name of CR-14, Whiteness Index Color Reader, manufactured by Minolta Co.,Ltd.). while, the "detergency ratio" as defined below was calculated.

Detergency ratio %=(whiteness index of stained fabric after washing−whiteness index of stained fabric before washing)÷(whiteness index of unstained fabric−whiteness index of stained fabric before washing)×100

Also, moisture type artificially stained fabrics (manufactured by The Foundation of Washing Science Association) were washed with the washing water of the present embodiment by using the same washer as the above for 20 minutes. The result of the detergency ratio of the fabrics after washing is shown in Table 2. Note that the "detergency ratio" is calculated in the same way as the above.

EXAMPLE 2

Other than setting the temperature of tap water for diluting by 30 times the electrolytic solution at the cathode side generated at 40° C., conditions were the same as in the Example 1. The obtained washing water before being softened had a pH of 10.5, an EC of 207.0 mS/m, a calcium hardness of 40 ppm, a total hardness of 60 ppm and a water temperature of 40° C. The results thus obtained are shown in Table 2.

EXAMPLE 3

Other than leaving the obtained washing water before being softened for 6 hours, conditions were the same as in the Example 1. The obtained washing water before softening had a pH of 10.7, an EC of 205.0 mS/m, a calcium hardness of 40 ppm, a total hardness of 60 ppm, and a water temperature of 20° C. The results thus obtained are shown in Table 2.

EXAMPLE 4

Other than adding 12 g of EDTA 15 minutes after starting washing, conditions were the same as in the Example 1.

Note that the total hardness of the water inside the bath 15 minutes after starting washing was 30 ppm. The results thus obtained are shown in Table 2.

EXAMPLE 5

Other than adding 15 cc of oleic acid 15 minutes after starting washing, conditions were the same as in the Example 1. Note that the total hardness of the water inside the bath 15 minutes after starting washing was 30 ppm. The results thus obtained are shown in Table 2.

Comparative Example 1

The same stained fabrics as in the Example 1 were washed using a commercially available synthetic detergent for washing (Attack, Kao Corporation) and a whiteness index and the detergency ratio were calculated. The results thus obtained are shown in Table 1.

Also, moisture type artificially stained fabrics (manufactured by The Foundation of Washing Science Association) were washed in the same way as in the Example 1 using the commercially available synthetic detergent for washing in the Comparative Example 1, and the detergency ratio was calculated. The results thus obtained are shown in Table 2.

Comparative Examples 2 and 3

Other than changing a pH and EC of the washing water before being softened by adjusting the electrolyzing conditions, conditions were the same as in the Example 1. The results thus obtained are shown in Table 2.

TABLE 1

| | Example 1 | | | Comparative Example 1 | | |
|---|---|---|---|---|---|---|
| | whiteness index (%) | | detergency | whiteness index (%) | | detergency |
| stained fabric | before washing | after washing | ratio (%) | before washing | after washing | ratio (%) |
| china ink, olive oil | 41.2 | 48.6 | 15.5 | 42.0 | 48.7 | 14.3 |
| blood | 40.4 | 86.1 | 94.0 | 40.8 | 64.6 | 49.4 |
| cacao | 54.0 | 67.1 | 37.4 | 53.6 | 60.9 | 20.6 |
| red wine | 68.7 | 76.6 | 38.9 | 69.4 | 77.0 | 38.8 |
| blood, milk, china ink | 36.9 | 50.0 | 25.1 | 37.6 | 49.3 | 22.8 |

TABLE 2

| | before being softened | | | after softening | | |
|---|---|---|---|---|---|---|
| | pH | EC | total hardness | total hardness | detergency ratio | note |
| Example 1 | 10.7 | 196.1 | 60 | 30 | 36.5 | stirring |
| Example 2 | 10.5 | 207.0 | 60 | 30 | 44.4 | heating |
| Example 3 | 10.7 | 205.0 | 60 | 30 | 39.3 | leaving still |
| Example 4 | 10.7 | 195.3 | 60 | 0 | 49.0 | Chelating agent |

TABLE 2-continued

| | before being softened | | | after softening | | |
|---|---|---|---|---|---|---|
| | pH | EC | total hardness | total hardness | detergency ratio | note |
| Example 5 | 10.7 | 196.2 | 60 | — | 43.7 | fatty acid |
| Comp. Example 1 | 9.4 | 22.6 | 60 | — | 41.7 | |
| Comp. Example 2 | 8.3 | 114.5 | 60 | 60 | 27.8 | |
| Comp. Example 3 | 10.4 | 48.6 | 60 | 50 | 27.8 | |

It has been confirmed from the results that a washing process of the present invention shows the cleaning effect comparable to or more excellent than that of the commercially available synthetic detergent for washing. Note that the washing water of the Examples 1 to 5 has no problems at all as to safety and treatment of the waste water after washing.

What is claimed is:

1. A washing process, comprising:

providing washing water containing a hardness cation, wherein said washing water before being softened is an electrolyzed aqueous solution of sodium hydrogen carbonate;

adding to the washing water a mixture of a)alkali metal ion and b) at least one of carbonate ion and bicarbonate ion;

bonding said hardness cation with at least one of said carbonate ion and said bicarbonate ion to precipitate said carbonate or said bicarbonate in the washing water, thereby softening the washing water;

adding items to be washed to the washing water either before, during or after adding said mixture to said washing water; and washing said items with said washing water, wherein said precipitated carbonate or bicarbonate in said washing water removes dirt and stain from said items.

2. A washing apparatus comprising:

an electrolytic cell means for electrolyzing an aqueous solution of sodium hydrogen carbonate to form washing water comprising an electrolyzed aqueous solution of sodium hydrogen carbonate for washing items;

means for washing said items to remove dirt and stain from said items, said means for washing said items being in communication with said electrolytic cell means; and means for transporting said washing water comprising said electrolyzed aqueous solution of sodium hydrogen carbonate from said electrolytic cell means to said means for washing items.

* * * * *